US006122938A

United States Patent [19]

Henning et al.

[11] Patent Number: 6,122,938

[45] Date of Patent: Sep. 26, 2000

[54] STAMPED KNITTING TOOL

[75] Inventors: Uwe Henning, Burladingen; Ingo Landenberger, Messstetten; Klaus Wagner, Albstadt; Eckhard Fehrenbacher, Rottenburg-Seebronn, all of Germany

[73] Assignee: Groz-Beckert KG, Albstadt, Germany

[21] Appl. No.: 09/156,497

[22] Filed: Sep. 18, 1998

[30] Foreign Application Priority Data

Sep. 18, 1997 [DE] Germany ..... 197 40 985

[51] Int. Cl.[7] ..... D04B 35/02

[52] U.S. Cl. ..... 66/123

[58] Field of Search ..... 66/116, 119, 120, 66/121, 122, 123, 124

[56] References Cited

U.S. PATENT DOCUMENTS

| | | | |
|---|---|---|---|
| 3,949,572 | 4/1976 | Kopal et al. . | |
| 4,036,036 | 7/1977 | Ashmead et al. . | |
| 4,255,948 | 3/1981 | Sanders | 66/123 |
| 4,625,527 | 12/1986 | Fukuhara | 66/123 |
| 4,741,181 | 5/1988 | Plath | 66/123 |

FOREIGN PATENT DOCUMENTS

| | | |
|---|---|---|
| 1327453 | 4/1960 | France . |
| 2313485 | 12/1976 | France . |
| 680319 | 8/1939 | Germany . |
| 884 544 | 7/1953 | Germany . |
| 1 102 960 | 9/1961 | Germany . |
| 2 238 196 | 5/1974 | Germany . |
| 36 12 316 | 10/1986 | Germany . |
| 196 01 954 | 2/1997 | Germany . |
| 59-94655 | 5/1984 | Japan . |
| 60-127837 | 8/1985 | Japan . |
| 5-195394 | 8/1993 | Japan . |
| 2 173 518 | 10/1986 | United Kingdom . |

*Primary Examiner*—Larry D. Worrell, Jr.
*Attorney, Agent, or Firm*—Venable; Gabor J. Kelemen

[57] ABSTRACT

A stamped knitting tool, receivable for reciprocating motion in a guide groove of a knitting tool carrier forming a component of a knitting machine, includes a shank having a shank length, first and second opposite broad sides having outer faces, a full shank thickness defined by a distance between the outer face of said the first broad side and the outer face of the second broad side, and a guide region extending along a portion of the shank length. The guide region remains at all times within the guide groove when the knitting tool reciprocates in the guide groove. The knitting tool further has at least one butt carried by the shank; and at least one free surface which is provided in at least the first broad side. The free surface is recessed relative to the outer face of the first broad side, whereby a distance between the recessed free surface and the outer face of the second broad side defines a reduced shank thickness which is less than the full shank thickness. The recessed free surface extends in a direction of the shank length from the butt at least approximately to an end of the guide region.

27 Claims, 3 Drawing Sheets

STAMPED KNITTING TOOL

CROSS REFERENCE TO RELATED APPLICATION

This application claims the priority of German Application No. 197 40 985.7 filed Sep. 18, 1997, which is incorporated herein by reference.

BACKGROUND OF THE INVENTION

This invention relates to a stamped knitting tool, particularly for knitting and warp knitting machines having a carrier provided with at least one guide groove for reciprocating knitting tools and also relates to a knitting or warp knitting machine.

The knitting tool is of the type which has a shank provided with at least one butt and which has a guide region extending along at least one part of the shank length and which is at all times situated in the guide groove when the knitting tool is positioned therein. By knitting tools latch needles, hook needles, sinkers, or similar components are meant which are used for forming loops in a great variety of textile machines.

For example, circular knitting machines work with a needle cylinder which has axially parallel guide grooves separated from one another by guide webs and guiding back-and-forth shiftable latch needles therein. The needle cylinder is surrounded by a cylinder cam having at least one cam channel into which extends a butt which forms part of each individual latch needle and which projects radially beyond the guide webs of the needle cylinder. By virtue of a relative displacement between the needle cylinder and the cylinder cam, the required reciprocating motion of the latch needles in the guide grooves of the needle cylinder is conventionally generated. Basically the same considerations apply for a dial which, as a rule, is associated with the needle cylinder and which, dependent upon the type of the knitting machine, is also provided with latch needles or sinkers and with which a (dial cam) is associated.

During their reciprocating motion in the respective guide grooves, the latch needles or sinkers lie, with their narrow edge, on the bottom of the guide grooves while, at the same time, they are supported on their broad opposite faces by the laterally bounding guide webs on either side of the respective guide groove. Frequently, the shank of the latch needles has a "spring bend", that is, the shank is slightly bent (kinked) laterally about a line which is perpendicular to the shank axis. As a result, the shank, at least in its region oriented towards the needle hook, is maintained resiliently pressed against a guide web and thus may be guided without any lateral play.

With the increase of the knitting speed in current machines made possible by the latest needle and cam structures (for example, a needle cylinder rpm of over 28 for a needle cylinder diameter of 30 inches), the heat generated by the motion of the needle in the guide grooves has become increasingly significant. As a result of such a heat, the needle cylinder or the dial, as well as the heat-conducting components structurally connected therewith, attain an operating temperature in the order of magnitude of 80° C. and above during an extended operation. Such high operating temperatures cause mostly local, non-uniform dimensional changes of cooperating parts moving relative to one another. Thus, as a consequence, components of narrow tolerances such as guide webs, needles, cam parts and the like are exposed to an increased wear or may even mutually jam. Furthermore, the energy input for the machine drive increases to an undesired extent.

Viewed overall, such an increase in the operating temperature frequently has a limiting effect on a further increase of the operational rpm of the machine. Since the output of a circular knitting machine depends directly from its rpm, the efficiency of the machine is thereby also limited.

To remedy the above-outlined drawback, it has been attempted to improve the lubricating conditions for the knitting tools in the guide grooves to thus reduce the friction which appears during the reciprocating motion of the tool. Thus, for example, the needle shank of latch needles has been provided with longitudinally extending grooves which are oriented parallel to the needle back and are provided on at least one broad side of the shank as described in German Offenlegungsschrift (application published without examination) 36 12 316, to which correspond U.S. Pat. Nos. 4,625,527 and 4,681,150. Apart from a desired reduction of the inert mass of the needle by taking into account a reduction of the forces and jarring effects during acceleration and deceleration of the needle, an improved lubricant distribution over the guiding length of the shank needle has been sought to be achieved. Similar purposes are served by the construction of a needle shank described in Japanese Patent publication 5-195395 where the shank of a latch needle has, in the region between the needle head and the butt, at least one bridge which is disposed higher than the needle head. In the needle shank portion which couples the needle butt with the bridge, a depression is provided into which, during operation, lubricating oil is introduced by an oil supply device disposed in the cam jacket. The oil quantity which dwells in the depression is sought to provide a more effective lubricant distribution over the length of the guide region of the needle shank in the guide groove during a reciprocating motion of the latch needle and is further sought to result in an improved lubrication in the region of the butt proper.

Another approach for reducing the motion resistance in reciprocating knitting tools by improving lubrication is described in German Patent No. 196 04 954. In the stamped knitting tool (for example, a hook needle or a latch needle) described therein, the needle shank is at least on one of its two opposite broad side faces provided with lubricant distributing means having at least one region which is of reduced shank thickness and which is shaped as a chamfer or a recess oriented transversely to the longitudinal direction of the shank. Such a chamfer or recess extends from a location which is at a distance from the upper shank edge until or almost until the lower shank edge. In an alternative embodiment the lubricant distributing means provided at least on one of the two broad sides of the needle shank has at least in one region a reduced shank thickness formed as a depression which extends transversely to the longitudinal dimension of the shank and which further extends to or close to the lower shank edge. The depression has a substantially wedge-shaped or dish-shaped cross-sectional configuration. The width of such a depression, as viewed parallel to the length dimension of the needle shank, is, however, limited in achieving the intended purpose.

The above-noted measures for improving the lubricant distribution in guide grooves are generally effective. They do not, however, allow an increase of the operational rpm of circular knitting machines beyond a certain limit. Also, lubricant cannot be introduced in a desired quantity into the guide channels of the needle cylinder or the dial, because of the risk that the lubricant gains access to the fabric and soils the same, necessitating a subsequent cleaning of the fabric or other treatment which is an added expense and which in some instances cannot even be performed.

SUMMARY OF THE INVENTION

It is an object of the invention to provide improved measures in a knitting tool and/or in a guide groove region of a knitting or warp knitting machine which in operation, particularly at high speeds, reduce the heat-up of the machine without adversely affecting the economy of mass production of the knitting tools or without the need of taking into account a danger of deterioration of the knit fabric.

It is a further object of the invention to provide a knitting or warp knitting machine in which the operating speed may be increased relative to comparable conventional machines.

These objects and others to become apparent as the specification progresses, are accomplished by the invention, according to which, briefly stated, the stamped knitting tool, receivable for reciprocating motion in a guide groove of a knitting tool carrier forming a component of a knitting machine, includes a shank having a shank length, first and second opposite broad sides having outer faces, a full shank thickness defined by a distance between the outer face of said the first broad side and the outer face of the second broad side, and a guide region extending along a portion of the shank length. The guide region remains at all times within the guide groove when the knitting tool reciprocates in the guide groove. The knitting tool further has at least one butt carried by the shank; and at least one free surface which is provided in at least the first broad side. The free surface is recessed relative to the outer face of the first broad side, whereby a distance between the recessed free surface and the outer face of the second broad side defines a reduced shank thickness which is less than the full shank thickness. The recessed free surface extends in a direction of the shank length from the butt at least approximately to an end of the guide region.

In the stamped knitting tool according to the invention where a length portion (guide region) of the shank—when the knitting tool is inserted into a guide groove—is at all times situated within the guide groove, the shank has within such guide region at least on one broad side at least one recessed free surface, reducing the shank thickness. Such a free surface extends in the length direction of the knitting tool from the butt at least to the vicinity of a boundary of the guide region adjoining the butt.

By means of such a lateral free surface which may be provided on one or on both broad sides of the shank essentially in the guide region of the knitting tool, the friction which is generated in the guide groove, particularly in case of a small play, is significantly reduced while at the same time the resistance of tool motion caused by the lubricating oil is substantially diminished.

Since the shank, as a rule, has its full shank thickness in the zone of the butt (or the butts, in case the needle has more than one butt), the conditions of engagement of the butt with the associated cam channel are not adversely affected. At the same time the shank, independently from its back-and-forth motion, always remains laterally supported on the respective guide web at least at two regions which are spaced from one another in the longitudinal direction of the shank. Since the free surface or surfaces at least preponderantly lies or lie inside the guide region, it is ensured that even in a maximum extended (outwardly moved) position of the knitting tool, its superior lateral guidance in the guide groove is preserved.

The above-discussed results derived from a knitting tool structured according to the invention are in contrast with the conditions involving a transfer needle made of wire and described, for example, in German Patent No. 680,319. The shank of the transfer needle has a reduced shank thickness in the region ahead of the butt and along one part of the needle length. The shank portion having the reduced shank thickness starts shortly behind a shoulder-like projection which serves for the transfer of loops and which, in the extended position of the transfer needle, lies at the height of the needles of the other knitting head. The purpose of the reduction of the needle shank thickness is to render laterally elastically bendable that part of the needle shank which projects from the guide groove in the extended position of the needle in order to be able to transfer the loop, lying on the projection, onto a neighboring needle of the other knitting head. For this reason, the corresponding lateral recess of the needle shank projects from the guide groove at least in the extended position of the transfer needle. It is arranged on that side towards which the needle is pressed during loop transfer. Only during the retraction of the needle for the loop formation is the needle again guided in the guide groove along its full shank width. For high performance circular knitting machines which operate at high rpm's, such a configuration of the needle shank cannot be considered, because, among other reasons, during the outward travel of the needle no satisfactory lateral guidance of those needle parts is ensured which serve for the loop formation. Risks are not insubstantial that the needle heads of adjoining needles collide.

In another known transfer needle, as described in German Patent No. 1,102,960, the shank has a region of reduced cross section approximately in the middle between the needle butt and the needle head. For this purpose, on one broad needle side a rectangular depression is provided which starts at the needle back and ends shortly ahead of the upper needle edge. This depression too, which is relatively short in the longitudinal direction of the needle, is sought to facilitate a lateral bending of the needle by a loop bending device during loop transfer. Basically the same applies to a transfer needle described in German Patent No. 884,544 in which the needle shank, in the region between the butt and the needle head, is provided with a depression which facilitates a lateral bending of the needle shank. The depression is provided in the region of one broad side of the needle shank and is of rounded configuration.

Depressions extending on one or both broad sides of the needle shank from the upper shank edge to the lower shank edge have also been provided for other reasons. Thus, for example, U.S. Pat. No. 3,949,572 describes knitting machine needles which are slidably supported in needle channels or needle grooves and which are provided with a recess at the location of the butts for reducing the stiffness of the needles. In the alternative, recesses may be provided in the flanks of the needle channels which lie in the zone of motion of the butt of the respective needle and thus permit a lateral, elastic yielding of the needle shank in that zone. In this manner, a reduction or resilient absorption of the impact forces exerted by the cam parts on the butts are sought to be achieved. In contrast, in the knitting tools according to the invention, it is ensured that in the region of the butts a full shank thickness, that is, a throughgoing engagement face on the broad side of the needle is present and thus a highly satisfactory lateral guidance will occur.

In a latch needle for knitting machines disclosed in German Patent No. 2,238,196 the needle shank has along its length a laterally wavy configuration (that is, it is bent alternatingly in the one and the other lateral direction several times), so that a lateral engagement with the guide channel cheeks (that is, at the guide webs) alternates in a multiple manner. With such a construction a resilient yielding of the needle shank is to be achieved in response to the impacts exerted by the cam parts on the needle butt to thus reduce the danger of hook breakage. A similar objective is served by a needle structured according to U.S. Pat. No. 4,036,036. In the needle shank at least one lateral opening is provided which does not reach to the upper needle edge and to the lower needle edge and which is sought to lend the needle shank shock-damping properties.

It has been found in practice that circular knitting machines operating with latch needles structured according to the invention achieve, at the same given operational rpm, a reduction of the operational temperature at the needle cylinder by 12% compared to a needle cylinder containing latch needles of comparable, conventional construction. At the same time, the reduction of the resistance to the sliding motion of the needles achieved by the free surface or surfaces results in a reduction of the energy consumption of the circular knitting machine by 13%. Further, the generation of oil mist in the knitting room is also reduced.

The knitting tools according to the invention are simple to manufacture. The free surface on the shank may be provided by an embossing or pressing operation or by a material-removing process, such as grinding.

In knitting tools, for example, latch needles whose shank has a plurality of butts, it is expedient to provide at least one free surface according to the invention between adjoining butts. The principle applies that the free surface may extend immediately to the respective butt which borders it; nevertheless, particularly in "meandering" needles, it is frequently expedient if the free surface extends only to the vicinity of the respective butt.

In knitting tools, particularly in latch needles which have a "leading" guide portion in the shape of a bend or a height increase of the shank in front of the leading butt, it is of advantage to provide at least one free surface according to the invention in the region of the leading guide portion such that the free surface extends essentially over the entire length of the leading guide portion. It is feasible in such an arrangement that the free surface extends beyond the leading guide portion into an adjoining shank zone which is situated within the guide groove when the knitting tool is in an inserted position therein. If the knitting tool has a "trailing" guide portion constituted by an extension of the needle shank behind the last (trailing) needle butt then, as a rule, at least one free surface extends at least essentially over the entire length of such trailing guide portion. The free surface may cover the entire length of the trailing guide portion or may extend only to the vicinity of its end to ensure a lateral guidance of the shank in the guide groove even at the terminus of the needle.

In addition or as an alternative to the provision of free surfaces in the knitting tool, according to the invention such a free surface or surfaces may also be provided in components which form part of the knitting machine or the warp knitting machine proper. Accordingly, the guide grooves of the needle or sinker carriers of the machines have, at least at one of the groove side walls, at least one recessed free surface which extends from a first boundary in the vicinity of that end of the guide groove which adjoins the loop forming region, to a second boundary which is situated externally of the motion path covered by the butt of the reciprocating knitting tool. As a result of such an arrangement, the knitting tool is continuously supported at the lateral groove wall at least at two locations spaced from one another in the longitudinal direction of the tool shank. While, as a rule, the knitting tool has a constant shank thickness in case the free surfaces according to the invention are provided on the machine proper, it feasible to use the inventive knitting tool (having at least one recessed free surface) in a machine in which, according to the invention, at least one recessed free surface is provided in the zone of at least one lateral groove. In such an arrangement it has to be ensured that the knitting tool is, in its respective guide groove, continuously laterally supported in a proper manner at least at two locations spaced from one another in the length dimension of the tool shank. One of such locations should be situated at the end of the guide groove where the shank of the knitting tool projects from the guide groove.

It is to be noted that the invention is not limited to circular knitting machines; it may find application in flat bed knitting machines, warp knitting machines and the like that is, generally, in all textile machines which use knitting tools that are reciprocated in the guide grooves of a carrier.

DESCRIPTION OF THE PREFERRED EMBODIMENTS

Figures 1, 2, 3, 4, 5:
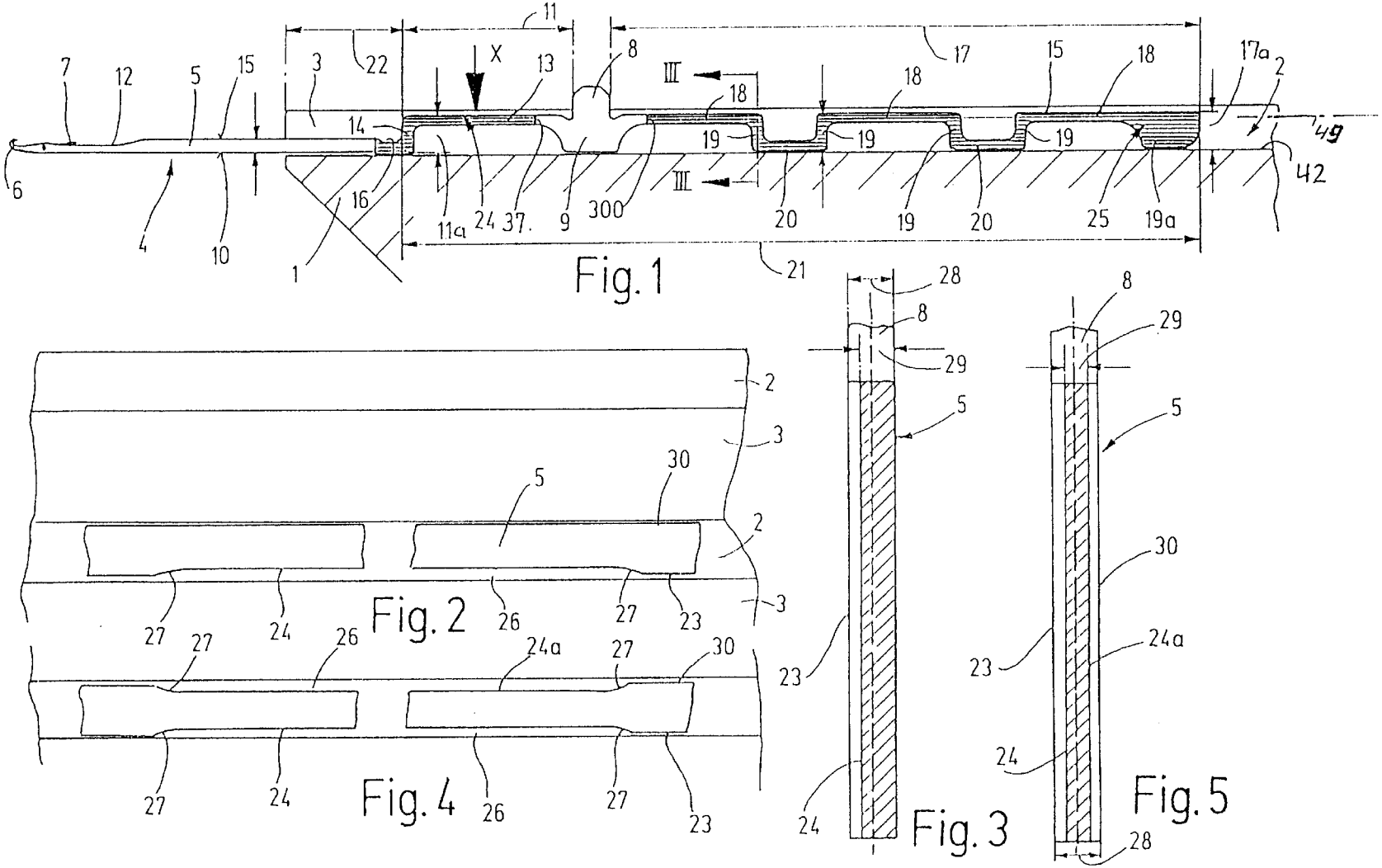
FIG. 1 is a sectional side elevational view of a carrier (such as a needle cylinder or a dial) of a knitting machine according to the invention, including a latch needle according to the invention, inserted in a guide groove of the carrier.
FIG. 2 is an enlarged top plan view of the construction of FIG. 1 in the zone of the arrow X.
FIG. 3 is an enlarged sectional view taken along line III—III of FIG. 1.
FIG. 4 is an enlarged top plan view of the construction of FIG. 1 in the zone of the arrow X, illustrating a variant of the embodiment shown in FIG. 2.
FIG. 5 is a view similar to FIG. 3, showing in section the construction illustrated in FIG. 4.

In FIG. 1, a portion of a needle cylinder of a conventional circular knitting machine is shown; in the schematic illustration it is turned 90° compared to its actual position. On the outer circumference of the needle cylinder 1 axially parallel guide grooves 2 are provided which are laterally bounded by radial guide webs 3 as also shown in FIG. 2. In each guide groove (guide channel) 2 a "meandering" type latch needle 4 is inserted which is guided with a slight lateral play between the two guide webs 3 bounding the guide groove 2. The latch needle 4 has a shank 5 which at one end carries a formed-on hook 6 which cooperates with a needle latch 7 movably supported in a sawslot of the shank 5. The shank 5 has on its upper edge a formed-on butt 8 which projects radially beyond the upper boundary of the guide webs 3 as may be observed in FIG. 1. Underneath the butt 8 the needle shank has a guide portion 9 which extends to the level of the lower edge (back) 10 of the shank 5 and which is supported on the bottom of the guide groove 2.

The latch needle has, at that side of the butt 8 which is oriented towards the hook 6, a leading guide portion 11 which is situated between the forward edge of the butt 8 and the needle shank 5 which extends to a sawslot 12. The leading guide portion 11 which the German Industrial Standard DIN ISO 8119 (DIN 62153) defines as a bend or an elevation of the shank ahead of the butt, has a height 11*a* and has essentially the shape of a bridge including a horizontal web 13 situated above the level of the shank back 10. The web 13 is supported on one side by a vertical guide portion 14 and on the opposite side by a guide portion 9 situated underneath the butt 8. The vertical guide portion 14 is immediately adjoined in the forward direction (that is, toward the hook 6) by a short, trough-shaped depression 16.

The rearwardly oriented edge of the butt 8 (that is, the edge which is oriented away from the hook 6) is adjoined by a trailing guide portion 17 which extends to the end of the needle shank. According to the above-noted German Industrial Standard (DIN) such a portion is designated as an extension of the needle after the butt. The trailing guide portion 17 has a height 17*a* which, in the illustrated example, is identical to the height 11*a*. The trailing guide portion 17 is of meandering shape, that is, it is composed of a series of bridges which have horizontal webs 18 situated above the level of the shank back 10, vertical guide portions 19 connected with the horizontal webs 18 and horizontal connecting webs 20 extending at the height level of the shank back 10. The guide portion 19*a* situated at the end of the needle is, as viewed in the length direction of the needle, wider than the guide portions 19 which precede it.

The region of the needle shank 5 which extends along the length of the leading guide portion 11, the width of the butt 8 and the length of the trailing guide portion 17 constitutes the "guide region" of the needle and is designated at 21 in FIG. 1. The guide region 21 extends from the front edge of the guiding portion 14 to the end of the needle shank 5.

When the latch needle is in place in the guide groove 2, during the reciprocation of the needle caused by the needle cam, the needle shank 5, or at least the guide region 21, is continuously within the guide groove 2. Stated differently, this means that during operation, the latch needle is at no time advanced out of the guide groove 2 to such an extent that any part of the needle shank 5 which lies within the guide region 21 exits the guide groove 2. As a rule, in practice the arrangement is such that in addition to the guide region 21 there is provided a smaller length portion 22 of the shank 5 which extends between the leading guide portion 11 and the sawslot 12, including the trough-shaped depression 16, that remains continuously within the guide groove 2, and therefore the length portion 22 also constitutes a "guide region", similarly to the guide region 21. Such a state is depicted in FIG. 1 which shows the latch needle in its maximum extended position.

Within the guide region 21 the shank 5 is, on one broad side 23 (FIG. 2) provided with two recessed free surfaces 24, 25. Each free surface 24, 25 constitutes the bottom of an edgewise rounded recess provided in the broad side 23 of the shank 5 and extending in its width from the upper shank edge to the lower shank edge or shank back 10. The trough-like recess 26 whose bottom constitutes the free surface 24 is shown in FIG. 2. The rounded edges of the recess 26 are designated at 27. As shown in FIG. 3, in the region of the free surfaces 24, 25 the normal shank thickness 28 is reduced to a lesser shank thickness 29. The extent of the reduction of the thickness 28 to the thickness 29 depends, among others, from the fineness, the needle structure and the configuration of the shank 5. In practice, such a reduced thickness is between approximately 5% and 35% of the full shank thickness 28.

The two free surfaces 24 and 25 which are recessed relative to the broad side 23 of the needle shank are symbolically shown in FIG. 1 with closely drawn parallel lines extending in the longitudinal direction of the needle 4. Thus, the recessed free surface 24 extends in the longitudinal direction of the needle from a boundary 37 in the vicinity of the leading edge of the butt 8 substantially to the front end of the trough-shaped depression 16, that is, slightly beyond the boundary of the guide region 21. In the alternative, the recessed free surface 24 may end immediately at the boundary or in the vicinity ahead of the boundary of the guide region 21. The other recessed free surface 25 extends from a boundary 300 in the vicinity of the trailing edge of the butt 8 until the rearward end of the needle shank 5.

In the alternative, both free surfaces 24 and 25 may extend over the entire length of the leading guide portion 11 and the trailing guide portion 17, respectively, while their boundaries 37, 300 immediately adjoin the respective leading and trailing edges of the butt 8. In any event, however, the butt 8 and the underlying guide portion 9 have the full (non-reduced) shank thickness 28.

As may be seen in FIG. 1, both recessed free surfaces 24 and 25 extend essentially over the entire length of the bridge lying within the leading guide portion 11, including the length of the trough-shaped depression 16 as well as the bridges situated within the trailing guide portion 17. The webs and the guide portions 13, 14 and, respectively, 18, 19 and 19*a* are, as a rule, recessed by the same extent so that they lie in the respective free surfaces 24 and 25. These, however, may also be recessed to an unlike extent. The webs 13 and 18 immediately adjoining the butt 8 are recessed over the greater part of their length, because the boundaries 37 and 300 of the free surfaces 24, 25 lie at the same distance from the butt 8. In practice, these distances of the boundaries 37, 300 from the respective adjoining edges of the butt 8 are at the most approximately between 10–15 mm; as a rule, however, the distances are shorter.

In the embodiment illustrated in FIGS. 1, 2 and 3, the two recessed free surfaces 24 and 25 are provided only on the broad side 23 of the shank 5. It is to be understood that they may be present on the opposite broad side 30 or, as illustrated in FIGS. 4 and 5 for the free surfaces 24, 24*a* situated in the region of the leading guide portion 11, they may be provided on both broad sides 23, 30 of the needle shank 5. While in the illustrated embodiment the free surfaces 24, 24*a* are situated in a mirror-image arrangement, it is feasible to arrange them slightly offset in the longitudinal direction of the needle or they may have different lengths. In any event, they are positioned at least partially in an overlapping relationship in the length direction of the needle.

The free surfaces may be provided by a pressing or embossing step during the stamping of the needle blank or by a material removing operation, such as grinding. Since the width of the free surfaces extends continuously from the upper shank edge 15 to the lower shank edge 10, the required shaping operations are technologically easy to perform, and thus no significant added expense is involved with the manufacture of needles that include the recessed free surfaces according to the invention.

The latch needle shown in FIG. 6 essentially corresponds in many respects to those described in connection with FIGS. 1–5. The latch needle according to FIG. 6 differs from that of FIG. 1 by the provision of a plurality of butts, of which butts 8 and 8*a* are illustrated. The guide region 21*a* extends over the length of the leading guide portion 11, the width of the butt 8 as viewed along the needle length, the region 31 situated between the two butts 8 and 8*a* and the length of the trailing guide portion 17. Within the guide region 21*a* between the two butts 8, 8*a* a further free surface 33 is provided which is recessed relative to the broad side of the needle shank 5*a* while the shank thickness is reduced. The free surface 33 extends from the boundary 300 located in the vicinity of the trailing edge of the leading butt 8, along the intermediate webs 18, 20 and the guide pieces 19, to a boundary 300*a* located in the vicinity of the leading edge of the trailing butt 8*a*.

The recessed free surface 25*a* which lies within the trailing guide portion 17 terminates in the illustrated example at 300*c* ahead of the terminal guide portion 19*a* so that the latter preserves the full shank thickness 28. The free surface 25*a* extends at its other end to the boundary 300*b* located in the vicinity of the trailing edge of the trailing butt 8*a*. The distances of the boundaries 37, 300, 300*a* and 300*b* from the facing edge of their respective butts 8, 8*a* are dimensioned as in FIG. 1. By virtue of the fact that the terminal guide portion 19*a* preserves the full shank thickness 28, the trailing guide portion 17 at the shank end maintains its lateral guiding function in cooperation with the guide groove 2. This may be of significance particularly in case of trailing guide portions of substantial length.

Figure 6:
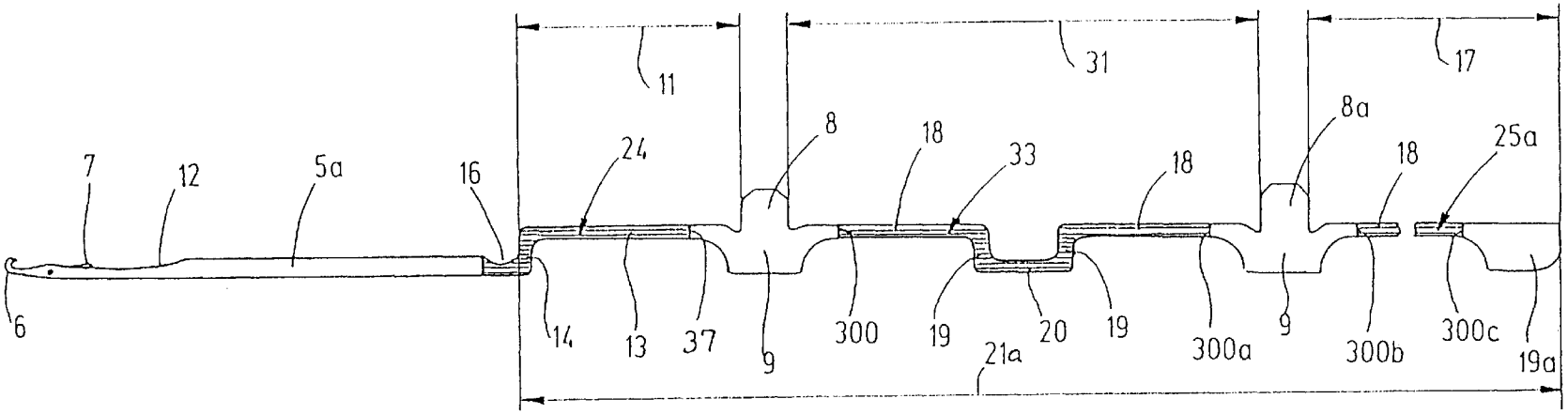
FIG. 6 is a side elevational view of another preferred embodiment of a latch needle according to the invention.

In the embodiment of FIG. 6 too, the recessed free surfaces 24, 33 and 25*a* may be provided selectively on the frontal or the rearward broad side or on both broad sides of the shank 5*a*. The configuration and dimension of the reduction of the shank thickness in the region of the free surfaces involve the same considerations as those discussed in connection with the embodiment illustrated in FIG. 1.

The configuration of a latch needle having recessed free surfaces on a broad side of the shank as described, is not limited to meandering needles such as shown in FIGS. 1 and 6; rather, the measure according to the invention may find application in knitting tools independently from the shape of the tool shank.

Figure 7:
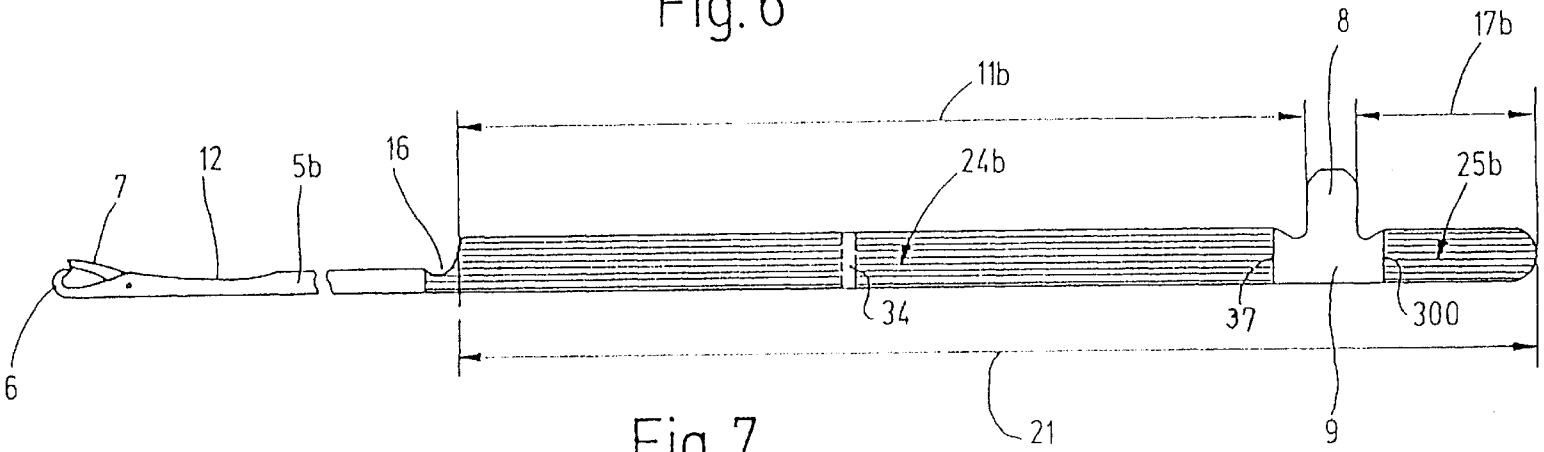
FIG. 7 is a side elevational view of yet another preferred embodiment of a latch needle according to the invention.

Thus, FIG. 7 schematically shows a "full shank" needle in which the leading guide portion 11*b* formed as an elevated part of the shank 5*b* in front of the butt 8 has at least one recessed free surface 24*b* which extends from the boundary 37 situated adjacent the leading edge of the butt 8 to slightly beyond the end of the guide region 21 and beyond the adjoining trough-shaped depression 16 into the shank portion which leads to the sawslot 12.

The other recessed free surface 25*b* lying within the trailing guide portion 17*b* reaches from the boundary 300 adjoining the butt 8 at its trailing edge until the end of the shank. The butt 8 and the underlying guide portion 9 have the full shank thickness 28, as shown in FIG. 3.

As concerns the extent of the reduction of shank thickness in the region of the free surfaces 24*b* and 25*b*, the same considerations apply as those described in connection with FIGS. 1 and 6. In the type of needle shown in FIG. 7 too, the free surfaces may be provided on the one or the other or on both broad sides of the shank 5*b*.

By the provision of the free surfaces, such as 24, 25 which, as described in connection with FIGS. 1–7, are recessed relative to the outer surfaces of the broad sides of the needle shank 5, 5*a*, 5*b*, the sliding resistance of the needle in the guide groove 2 is substantially diminished because the area of the effective lateral faces of the needle shank in sliding contact with the adjoining wall of the associated guide web 3 has been significantly reduced. At the same time, during the reciprocating motion of the needle, the resistance caused by the lubricant oil in the guide groove 2 is also significantly reduced.

Since the needle shank 5, 5*a*, 5*b* at least in a region which adjoins the frontal boundary of the guide region 21 (and which, independently from the reciprocating motion of the needle, remains continuously within the guide groove 2) and in a region of the butt 8 which adjoins the leading guide portion 11, 11*b* maintains its full shank thickness 28, its highly satisfactory lateral guidance in the guide groove 2 is preserved. This is significant for the operation of the loop forming portions, that is, the hook 6, the latch 7 and the sawslot 12. The shank 5 is always guided with a slight lateral play between the respective guide webs 3 at least at two shank regions spaced from one another in the longitudinal direction of the shank. In the embodiment of FIG. 1 one such shank region is located in front of the trough-like depression 16 and the other is situated at the guide portion 9, including adjoining parts of the webs 13 and 18.

If required, the shank parts situated in the zone of the trailing guide portions may be guided laterally at the shank end, for example, by the terminal guide portion 19*a* which has the full shank thickness 28. In the alternative or in addition, it is also feasible, particularly in long needles—which accordingly also have longer recessed free surfaces—to support the shank at intermediate locations laterally on the adjoining guide webs 3. For this purpose, for example, in the region of at least one of the recessed free surfaces, dot or strip-like supporting locations may be formed where the shank has its full shank thickness 28. FIG. 7 schematically illustrates one of such supporting locations at 34.

The invention is essentially based on the recognition that the stability of the knitting tool is not significantly affected by the large-surface thickness reductions in the zone in front and occasionally behind the butt as well as between the butts in multi-butt needles. It is sufficient, as explained earlier, to guide the shank along a lateral wall of the guide groove at all times at least at two locations which are spaced from one another in the longitudinal direction of the knitting tool, and to ensure that one of the locations is always situated within the frontal region of the guide groove. The butt and the shank need not have the same thickness; it is sufficient if the knitting tool is continuously laterally supported on a side wall of the guide groove at least at two tool locations spaced from one another in the longitudinal direction of the shank.

The effect of a significant reduction of the resistance to the tool reciprocation obtained by the invention may frequently be achieved by a relatively slight reduction of the shank thickness. For example, it may suffice to recess the free surfaces merely by 0.05 to 0.5 mm.

In principle, the invention may also be implemented in such a manner that the described recessed free surfaces are provided not on the shank 5 of the knitting tool, but on the knitting machine, namely in at least one of the side walls 42 of the respective guide grooves 2. Since, for example, in a circular knitting machine, the lateral forces exerted on the knitting tools and derived from the rotation of the needle cylinder or the dial press the knitting tools against one lateral wall of the needle channel or needle groove, it is sufficient, as a rule, to provide the recessed free surfaces according to the invention only in one groove wall, namely, in the groove wall against which the knitting tool is laterally pressed. Dependent on the type of the knitting or warp knitting machine as well as the guidance of its knitting tools in the guide grooves, both side walls defining a guide groove 2 may be provided with recessed free surfaces.

Figure 8:
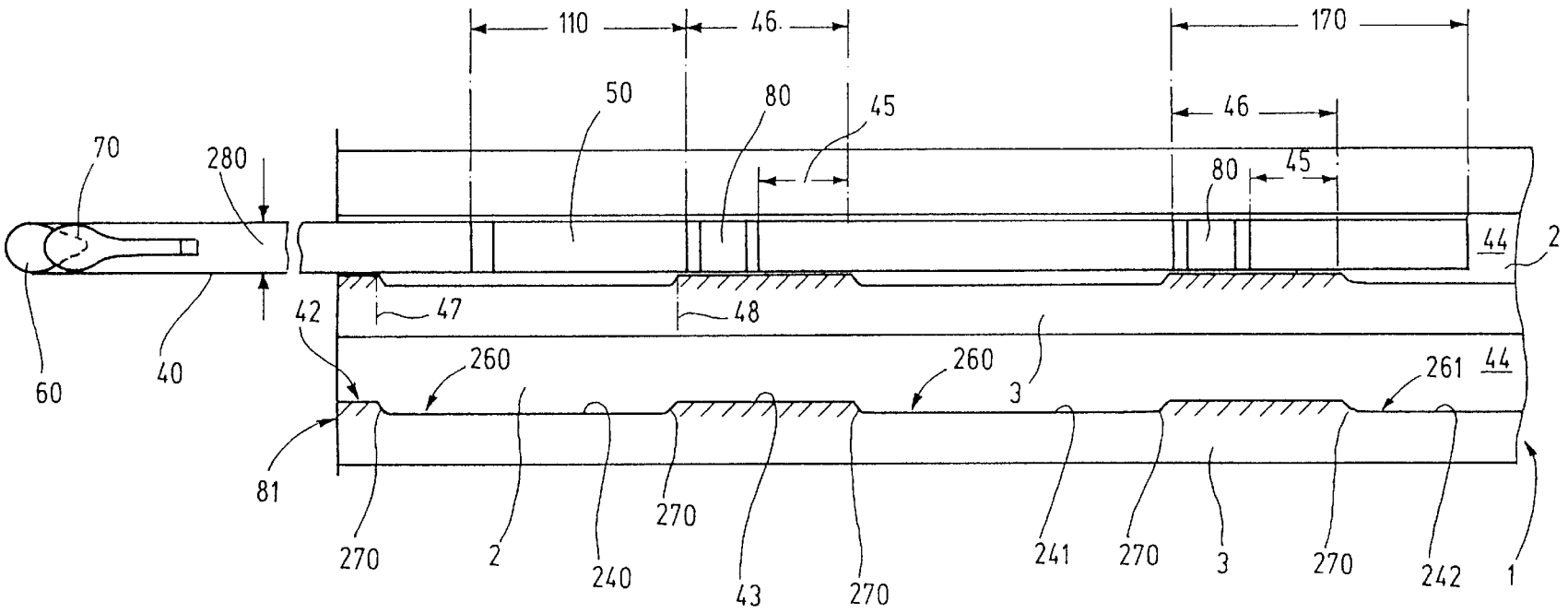
FIG. 8 is a top plan view of a needle carrier of a knitting or warp knitting machine according to the invention, including a latch needle supported for reciprocation therein.

FIG. 8 illustrates an embodiment in which the invention is applied to a knitting tool carrier of a knitting or warp knitting machine. For the sake of simplicity the knitting tool carrier is the needle cylinder 1 shown in FIG. 1. The guide grooves 2 bounded laterally by the parallel guide webs 3 each receive a respective latch needle 40 which may be a full-shank needle similar to that illustrated in FIG. 7. The needle 40 which is shown only schematically, has a needle shank 50 on which two butts 80 are formed. The butts 80 which are spaced from one another in the longitudinal direction of the needle shank and which essentially correspond to the butts 8 of FIG. 1, project beyond the outer edges of the guide webs 3 and extend into a non-illustrated cam channel. The needle shank 50 which has a uniform shank thickness 280 along its entire length, carries at its end a hook 60 which cooperates with a needle latch 70 in a manner known by itself. The needle hook 60 and the needle latch 70 lie in the loop forming region of the knitting or warp knitting machine. The loop forming region extends to the knockover edge 81 of the needle cylinder 1.

Each guide groove 2 is laterally bounded by the inner faces of two adjoining guide webs 3, forming groove side walls 42. One side wall 42 of each guide groove 2 is provided with three free surfaces 240, 241 and 242 recessed relative to the outer surface 43 of the side wall 42. These three free surfaces extend in the shown embodiment from the groove bottom 44 over the entire height of the guide webs 3 (in FIG. 8 the height dimension of the webs 3 is perpendicular to the plane of the drawing). The free surfaces 240 and 241 constitute the bottom of a respective trough-like depression 260 which is rounded at 270 at its edges. A depression 261 which contains the free surface 242 has only a single rounding 270 and extends at its other end to the end of the guide groove 2.

The extent to which the free surfaces 240, 241 and 242 are recessed relative to the lateral wall surface 43 corresponds approximately to that of the free surfaces of the latch needle described in conjunction with FIGS. 1–7.

In FIG. 8 the latch needle is shown in its maximum extended position similarly to FIG. 1. During loop formation, starting from such a maximum outwardly driven position to the knockover position, the needle is moved through a predetermined stroke 45 towards the right. As a rule, the stroke length is approximately 9–15 mm. Accordingly, during the reciprocating motion of the latch needle in the longitudinal direction of the shank, each butt 80 sweeps a region having a maximum length designated at 46.

The free surface 240 positioned in front of the first butt 80 extends from a boundary 47 located in the vicinity of that end of the guide groove 2 which is oriented towards the loop forming zone, to a second boundary 48 which is situated externally of the region 46 swept by the first butt 80 during the reciprocating motion of the latch needle.

The second free surface 241 is situated between the regions 46 swept by the two butts 80 during the reciprocating motion of the latch needle, while the third free surface 242 extends in a zone between the region 46 swept by the second butt and the end of the guide groove which is oriented away from the loop forming region.

As a result of the above-described arrangement shown in FIG. 8, the shank 50 of the latch needle 40 is laterally continuously supported in a superior manner by that guide web 3 against which the needle shank 50 is continuously pressed. Such a support is effected in a region in which the needle exits from the guide groove 2 and enters into the loop forming zone as well as in the region of the two butts 80. In the region situated therebetween, that is, in the region in which the recessed free surfaces 240, 241 and 242 extend, the shank 50 is laterally free, as a result of which the resistance to the displacement of the needle shank in the guide groove 2 is significantly reduced. As viewed in the longitudinal direction of the needle, the free surface 240 extends essentially over the leading guide portion 110, over a preponderant part of the shank length which is situated between the two adjoining butts 80 and over the length of the trailing guide portion 170.

In latch needles which, similarly to the latch needle of FIG. 1, only have a single butt 80, at least the free surface 240 situated in front of the butt is present, which, if needed, is joined by that free surface 242 which is associated with the trailing guide portion 170. Consequently, viewed overall, conditions similar to those shown in FIG. 1 are obtained.

It is further to be noted that the described free surfaces 240, 241 and 242 may be provided on both lateral guide groove walls of the guide groove 2 if required by the type or operation of the knitting or warp knitting machine. Also, in principle it is feasible that the needles operating in such guide grooves, have shanks provided with recessed free surfaces as described in connection with FIGS. 1–7. In such a case it has to be ensured that, as noted before, the shank 50 is continuously laterally supported in the regions shown by cross-hatching in FIG. 8 at the end of the guide groove oriented towards the loop forming zone as well as in the regions 46 swept by the butts 80 during the reciprocating motion of the needle.

For simplifying the manufacture, the guide webs 3 are provided over their entire height with the recessed free surfaces 240, 241 and 242; these may be, for example, ground into the web 3 before inserting them into the needle carriers. Embodiments are feasible, however, where the free surfaces 240, 241 and 242 do not extend along the entire height of the respective groove side wall 42 but terminate slightly below the upper shank edge 15 as shown in FIG. 1 by a dash-dotted line 49.

The free surfaces 240, 241 and 242 may also be subdivided in the length direction of the shank or may have dot-like or web-like supporting locations for the shank 50 as illustrated for the shank needle at 34 in FIG. 7.

It will be understood that the above description of the present invention is susceptible to various modifications, changes and adaptations, and the same are intended to be comprehended within the meaning and range of equivalents of the appended claims.

What is claimed is:

1. A stamped knitting tool receivable for reciprocating motion in a guide groove of a knitting tool carrier forming a component of a knitting machine; the knitting tool comprising (a) a stamped, single-piece shank having a shank length, first and second opposite broad sides having outer faces, a front end, a rearward end opposite said front end, a full shank thickness defined by a distance between the outer face of said first broad side and the outer face of said second broad side, and a guide region having a front end oriented toward said front end of said shank and a rearward end oriented toward said rearward end of said shank; said front end of said guide region being spaced from said front end of said shank and said rearward end of said guide region being situated at said rearward end of said shank; said guide region remaining at all times within the guide groove when the knitting tool reciprocates in said guide groove;

(b) at least one butt carried by said shank; said at least one butt being situated in said guide region and being a leading butt as viewed from said front end if more than one butt is present; said one butt having a front end oriented toward said front end of said shank and a rearward end oriented toward said rearward end of said shank; and (c) at least one free surface being provided in at least said first broad side; said free surface being recessed relative to said outer face of said first broad side, whereby a distance between the recessed free surface and the outer face of said second broad side defines a reduced shank thickness which is less than said full shank thickness; said recessed free surface having a first length portion extending within said guide region continuously through said shank on said first broad side from a point situated in a zone extending adjacent said one butt forwardly from said forward end of said one butt to an ending location spaced from said forward end of said guide region; said recessed free surface having a second length portion extending from a point situated in a zone extending adjacent said one butt rearwardly from said rearward end of said one butt toward said rearward end of said shank; said second length portion of said recessed free surface being interrupted solely along a guide region length portion which extends in alignment with any additional butt carried by said shank, whereby said one butt and a guide region length portion extending in alignment therewith and any additional butt and a guide region length portion extending in alignment therewith have said full shank thickness; said shank having first and second longitudinally spaced shank portions of full shank thickness situated within said guide region; said first shank portion comprising said guide region length portion extending in alignment with said one butt and said second shank portion comprising a shank length portion being located between said ending location of said first length portion of said recessed free surface and said front end of said guide region.

2. The stamped knitting tool as defined in claim 1, further comprising at least one strip-shaped supporting location having said full shank thickness and being provided on at least one said recessed free surface.

3. The stamped knitting tool as defined in claim 1, further comprising at least one dot-shaped supporting location having said full shank thickness and being provided on at least one said recessed free surface.

4. The stamped knitting tool as defined in claim 1, wherein said reduced shank thickness is about 5%–35% less than said full shank thickness.

5. The stamped knitting tool as defined in claim 1, wherein said reduced shank thickness is about 25% less than said full shank thickness.

6. The stamped knitting tool as defined in claim 1, wherein said recessed free surface terminates at a distance of at most 10 mm–15 mm from said butt.

7. The stamped knitting tool as defined in claim 1, wherein said recessed free surface is a first recessed free surface; further comprising a second recessed free surface provided on said second broad face and at least partially overlapping said first recessed free surface.

8. The stamped knitting tool as defined in claim 7, wherein a shank thickness measured between overlapping portions of said first and second recessed free surfaces is about 25% less than said full shank thickness.

9. The stamped knitting tool as defined in claim 7, wherein a shank thickness measured between overlapping portions of said first and second recessed free surfaces is about 5%–35% less than said full shank thickness.

10. The stamped knitting tool as defined in claim 1, wherein said shank has opposite upper and lower longitudinal edges extending at a spacing from one another; said spacing defining a shank height; said shank having a plurality of spaced webs each connected to said shank by guide portions extending continuously from the upper shank edge to the lower shank edge, whereby said shank has a meandering shape as viewed along said shank length; said recessed free surface extending on at least one of said webs at least through more than one half of a length of said one web and on at least one of the guide portions connecting said one web to said shank.

11. The stamped knitting tool as defined in claim 10, wherein said recessed free surface extends over the length of said one web and over the length of said guide portions connecting said one web to said shank.

12. The stamped knitting tool as defined in claim 10, wherein at least one of said webs has a height less than said shank height.

13. The stamped knitting tool as defined in claim 1, wherein said shank has opposite upper and lower longitudinal edges extending at a spacing from one another; said spacing defining a shank height; wherein said recessed free surface constitutes a bottom of a recess having a width extending from the upper shank edge to the lower shank edge.

14. The stamped knitting tool as defined in claim 13, wherein said recess has rounded edges.

15. The stamped knitting tool as defined in claim 1, wherein said; guide region has a leading guide portion having a length and extending from said butt toward said front end; said leading guide portion being constituted by one of an elevation and bent portion of said shank; said recessed free surface extending essentially over said length of said leading guide portion.

16. The stamped knitting tool as defined in claim 1, wherein said free surface is a surface pressed into said shank.

17. The stamped knitting tool as defined in claim 1, wherein said free surface is a surface embossed into said shank.

18. The stamped knitting tool as defined in claim 1, wherein said free surface is a surface machined into said shank by material removal.

19. In a knitting machine including a knitting tool carrier having a plurality of guide grooves each defined by a groove bottom and groove side walls; said guide grooves having a first end oriented toward a loop forming region and an opposite second end oriented away from said loop forming region;

a stamped knitting tool received in respective said guide grooves for reciprocating motion therein; each said knitting tool having a shank, and at least one butt carried by said shank and an end oriented toward said loop forming region; said butt sweeping a region during reciprocation of said knitting tool;

the improvement comprising at least one recessed free surface provided in at least one of said groove side walls and extending from a first boundary situated adjacent said first end of said guide groove to a second boundary situated externally of said region swept by said butt; said shank being supported on said at least one groove side wall at least at two locations spaced from one another in a length direction of said shank.

20. The knitting machine as defined in claim 19, further comprising a recessed free surface provided in at least one of said groove side walls and extending between said region swept by said butt and said second end of said guide groove.

21. The knitting machine as defined in claim 19, wherein said knitting tool has a plurality of butts spaced from one another in the length direction of said shank; further comprising a recessed free surface provided in at least one of said groove side walls and extending between regions swept by two adjoining butts during reciprocation of said knitting tool.

22. The knitting machine as defined in claim 19, wherein said groove side walls are formed by guide webs inserted into said carrier; said guide webs having a height measured perpendicularly to said groove bottom; at least one recessed free surface having a width extending throughout said height of said web.

23. The knitting machine as defined in claim 19, wherein at least one recessed free surface extends in said one groove side wall from said groove bottom to an outer edge of said one groove side wall.

24. The knitting machine as defined in claim 19, wherein said groove side walls have a height measured perpendicularly from said groove bottom; at least one recessed free surface provided in said one groove side wall has a width less than the height of said one groove side wall.

25. The knitting machine as defined in claim 19, wherein said shank of said knitting tool has opposite upper and lower longitudinal edges; at least one recessed free surface provided in said one groove side wall extending to a height level situated below said upper longitudinal edge of said shank of said knitting tool received in said guide groove.

26. The knitting machine as defined in claim 19, wherein said shank of said knitting tool has a shank length, first and second opposite broad sides having outer faces, a full shank thickness defined by a distance between the outer face of said first broad side and the outer face of said second broad side, and a guide region extending along a portion of said shank length; said guide region remaining at all times within the guide groove when the knitting tool reciprocates in said guide groove; further wherein said shank of said knitting tool includes at least one free surface being provided in at least said first broad side; said free surface provided in said first broad side being recessed relative to said outer face of said first broad side, whereby a distance between the recessed free surface provided in said first broad side and the outer face of said second broad side defines a reduced shank thickness which is less than said full shank thickness; said recessed free surface provided in said first broad side extending in a direction of said shank length from said butt at least approximately to an end of said guide region.

27. The stamped knitting tool as defined in claim 1, wherein said second length portion of said recessed free surface extends to a location adjacent to but spaced from said rearward end of said shank.

* * * * *